US011174565B2

(12) United States Patent
Watanabe et al.

(10) Patent No.: US 11,174,565 B2
(45) Date of Patent: Nov. 16, 2021

(54) PLATING LIQUID

(71) Applicant: MITSUBISHI MATERIALS CORPORATION, Tokyo (JP)

(72) Inventors: Mami Watanabe, Naka (JP); Kiyotaka Nakaya, Naka (JP); Yasushi Konno, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 6 days.

(21) Appl. No.: 16/497,032

(22) PCT Filed: Mar. 2, 2018

(86) PCT No.: PCT/JP2018/007997
§ 371 (c)(1),
(2) Date: Sep. 24, 2019

(87) PCT Pub. No.: WO2018/180192
PCT Pub. Date: Oct. 4, 2018

(65) Prior Publication Data

US 2020/0378023 A1 Dec. 3, 2020

(30) Foreign Application Priority Data

Mar. 27, 2017 (JP) ..... JP2017-061175
Feb. 26, 2018 (JP) ..... JP2018-031865

(51) Int. Cl.
*C25D 3/32* (2006.01)

(52) U.S. Cl.
CPC ..... *C25D 3/32* (2013.01)

(58) Field of Classification Search
None
See application file for complete search history.

(56) References Cited

FOREIGN PATENT DOCUMENTS

| | | | |
|---|---|---|---|
| JP | S58-64393 | A | 4/1983 |
| JP | S61-117298 | A | 6/1986 |
| JP | S63-161188 | A | 7/1988 |
| JP | 10-306396 | A | 11/1998 |
| JP | 2003-342778 | A | 12/2003 |
| JP | 2005-290505 | A | 10/2005 |
| JP | 2007-332447 | A | 12/2007 |
| JP | 2011-063834 | A | 3/2011 |
| JP | 2012-087393 | A | 5/2012 |
| JP | 2013-044001 | A | 3/2013 |

OTHER PUBLICATIONS

Masuda et al. (JP 2005-290505 A, machine translation). (Year: 2005).*
International Preliminary Report on Patentability dated Oct. 1, 2019, issued for PCT/JP2018/007997.
International Search Report dated May 22, 2018, issued for PCT/JP2018/007997.
Office Action issued in Japanese Patent Application No. JP 2018-031865, dated Jul. 6, 2021.

* cited by examiner

*Primary Examiner* — Wojciech Haske
(74) *Attorney, Agent, or Firm* — Locke Lord LLP; James E. Armstrong, IV; Nicholas J. DiCeglie, Jr.

(57) ABSTRACT

This plating liquid contains (A) a soluble salt that contains at least a stannous salt, (B) an acid selected from organic acids and inorganic acids or a salt thereof, and (C) two kinds of surfactants of an amine-based surfactant (C1) and a nonionic surfactant(s) (C2 and/or C3). The amine-based surfactant (C1) is a polyoxyethylene alkyl amine represented by general formula (1); and the nonionic surfactant(s) (C2 and/or C3) is a condensation product of a polyoxyethylene and a polyoxypropviene represented by general formula (2) or general formula (3). In formula (1), x is 12-18 and y is 4-12. In formula (2), m is 15-30 and (n1+n2) is 40-50. In formula (3), (m1+m2) is 15-30 and n is 40-50.

16 Claims, 1 Drawing Sheet

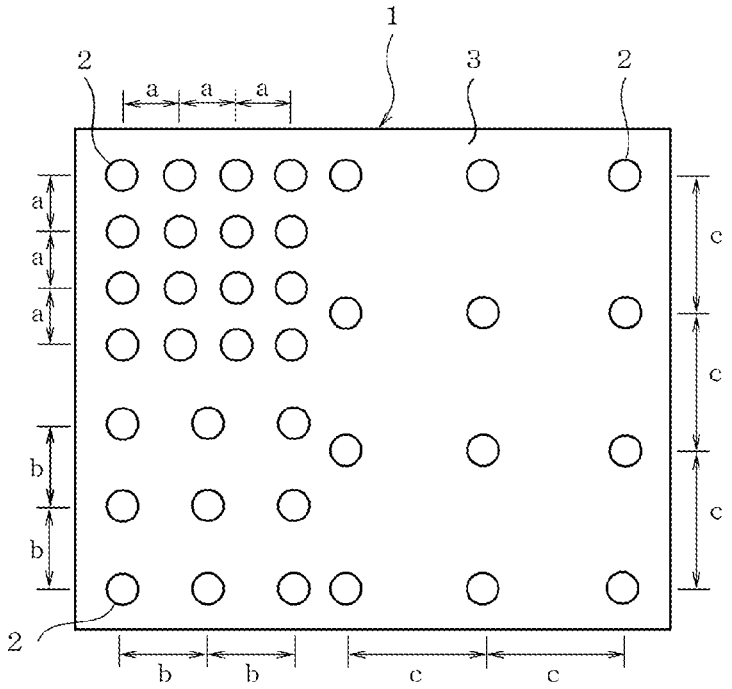
1
2
3
2
a
a
a
a
a
a
c
c
c
b
b
c
2
b
b
c
c

PLATING LIQUID

TECHNICAL FIELD

The present invention relates to a plating liquid for forming a plating film of tin or a tin alloy. More specifically, it relates to tin or a tin alloy plating liquid suitable for forming solder bumps for semiconductor wafers and printed circuit boards, has a uniform bump height in a wide range of a current density, and suppresses generation of voids during bump formation. This international application claims priorities based on Japanese Patent Application No. 61175 (Japanese Patent Application No. 2017-61175) filed on Mar. 27, 2017 and Japanese Patent Application No. 31865 (Japanese Patent Application No. 2018-31865) filed on Feb. 26, 2018, and the entire contents of Japanese Patent. Application No. 2017-61175 and Japanese Patent Application No, 2018-31865 are incorporated into this international application.

BACKGROUND ART

Heretofore, there has been disclosed a lead-tin alloy solder plating liquid comprising an aqueous solution containing at least one kind selected from an acid and a salt thereof, a soluble lead compound, a soluble tin compound, a nonionic surfactant and a formalin condensation product of naphthalenesulfonic acid or a salt thereof (for example, see Patent Document 1.). This plating liquid contains a formalin condensation product of naphthalenesulfonic acid or a salt thereof in an amount of 0.02 to 1.50% by mass based on the lead ion as an additive. In Patent Document 1, there is described that even if plating is carried out with a high current density by this plating liquid, it is possible to form a lead-tin alloy bump electrode which has a small variation in height on the surface and smooth, and has a small variation in lead/tin composition ratio.

In addition, there is disclosed a tin or a tin alloy plating bath containing (A) a soluble salt comprising any of a tin salt, and a mixture of a tin salt and a predetermined metal salt such as silver, copper, bismuth, lead, or the like, (B) an acid or a salt thereof, and (C) a specific phenanthroline dione compound (for example, see Patent Document 2.). In Patent Document 2, it is described that this plating bath contains a specific phenanthroline dione compound as an additive, so that according to this plating bath, excellent uniform electrodeposition and good film appearance can be possessed in a wide range of a current density region, and a uniform alloy composition can be obtained in a wide range of a current density region.

Further, there is disclosed a tin plating liquid containing a tin ion source, at least one kind of a nonionic surfactant, and imidazoline dicarboxylate and 1,10-phenanthroline as additives (for example, see Patent Document 3.). In Patent Document 3, it is described that according to this tin plating liquid, there is no burning in plating of highly complicated printed circuit boards, excellent in uniformity of distribution of film thickness in a plane, and also excellent in uniformity of plating at through-hole.

PRIOR ART DOCUMENTS

Patent Documents

Patent Document 1: JP 2005-290505A (Claim 1 and paragraph [0004])

Patent Document 2: JP 2013-044001A (Abstract and paragraph [0010])

Patent Document 3: JP 2012-087393A (Abstract and paragraph [0006])

SUMMARY OF THE INVENTION

Problems to be Solved by the Invention

For the plating liquid of tin or a tin alloy for forming solder bumps as a plating film for semiconductor wafers or printed circuit boards, uniformity in thickness of the plating film, that is, uniformity in a die (within-die; WID) which is a height of the solder bumps is required. Uniformity of the height of the solder bumps has now been improved by the plating liquid of tin or the tin alloy containing additives described in the above-mentioned conventional Patent Documents 1 to 3, but in recent years, a demand on quality for the plating film is heightened, and further improvement in uniformity of the height of the solder bumps has been required.

In addition, when bumps provided on a substrate for connecting a semiconductor device in flip chip mounting are to be formed by a plating method, a cavity called a void is sometimes formed inside the bumps after reflow processing, and it is required not to form the voids which may cause bonding failure. However, there is a contradictory relationship between the improvement in uniformity of the height of the solder bumps and to suppress occurrence of the voids when the bumps are formed, so that an additive for the plating liquid which solves both these problems has been required.

An object of the present invention is to provide a plating liquid in which uniformity of the height of the solder bumps can be achieved in a wide range of a current density, and occurrence of voids can be suppressed when the bumps are formed.

Means to Solve the Problems

The first aspect of the present invention is directed to a plating liquid which comprises (A) a soluble salt containing at least a stannous salt, (B) an acid selected from an organic acid and an inorganic acid or a salt thereof, and (C) an additive. The characteristic feature thereof resides in that the above-mentioned additive contains two kinds of surfactants of an amine-based surfactant (C1) and a nonionic surfactant(s) (C2 and/or C3), the above-mentioned amine-based surfactant (C1) is a polyoxyethylene alkylamine represented by the following general formula (1), and the above-mentioned nonionic surfactant (C2 or C3) is a condensation product of a polyoxyethylene and a polyoxypropylene represented by the following general formula (3).

[Formula 1]

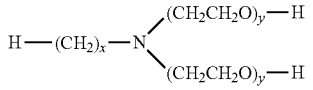

(1)

wherein, in the formula (1), x is 12 to 18 and y is 4 to 12.

[Formula 2]

(2)

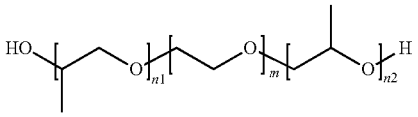

wherein, in the formula (2), m is 15 to 30 and n1+n2 is 40 to 50.

[Formula 3]

(3)

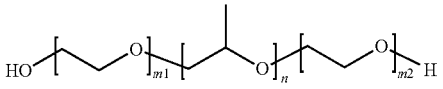

wherein, in the formula (3), m1+m2 is 15 to 30 and n is 40 to 50.

The second aspect of the present invention is an invention based on the first aspect, and is a plating liquid wherein the above-mentioned additive additionally contains two or more other additives among the other surfactant than the above-mentioned two kinds of the surfactants (C1, and C2 and/or C3), complexing agents, glossing agents and antioxidants.

Effects of the Invention

In the plating liquid of the first aspect of the present invention, an amine-based surfactant (C1) and a nonionic surfactant(s) (C2 and/or C3) both suppress precipitation of Sn ions during plating, so that it becomes possible to plate well on the surface of the object to be plated. When only the amine-based surfactant (C1) is used, the effect of suppressing precipitation of Sn ions at a low current density is too small, and when the solder bumps are formed, there causes fluctuation in the heights of the bumps. In addition, when only the nonionic surfactant(s) (C2 and/or C3) is used, at the time that the plating rate is increased by increasing the current density, Sn ions near the surface of the object to be plated are depleted and plating defects occur. By containing both an amine-based surfactant (C1) and a nonionic surfactant(s) (C2 and/or C3) as additives, defects of both surfactants are compensated for each other, uniformity of the heights of the bumps (WID) can be achieved in a wide range of a current density even if a plating rate is high, and occurrence of voids can be suppressed when bumps are formed.

In the plating liquid of the second aspect of the present invention, by further containing two or more other additives among a surfactant other than the two kinds of the surfactants (C1, and C2 and/or C3), a complexing agent, a glossing agent and an antioxidant, the following effects can be obtained. The surfactant other than the two kinds of surfactants (C1, and C2 and/or C3) exhibits effects of stabilization of the plating liquid and improvement in solubility, and the like. In addition, when the plating liquid contains a noble metal such as silver and the like, the complexing agent stabilizes noble metal ions and the like in a bath and makes the composition of the deposited alloy uniform. The glossing agent imparts gloss to the plating film. Further, the antioxidant prevents oxidation of the soluble stannous salt to a stannic salt.

BRIEF DESCRIPTION OF THE DRAWING

FIG. 1 is a plan view of a wafer having a resist layer produced in Examples.

EMBODIMENTS TO CARRY OUT THE INVENTION

Next, the embodiments to carry out the present invention is explained.

The plating liquid of the present invention is a plating liquid of tin or a tin alloy, and contains (A) a soluble salt containing at least a stannous salt, (B) an acid selected from organic acids and inorganic acids or a salt thereof, and (C) an additive. This additive contains two kinds of surfactants of an amine-based surfactant (C1) and a nonionic surfactant(s) (C2 and/or C3), the amine-based surfactant (C1) is a polyoxyethylene alkylamine represented by the above-mentioned general formula (1), and the nonionic surfactant (C2 or C3) is a condensation product of a polyoxyethylene and a polyoxypropylene represented by the above-mentioned general formula (2) or the general formula (3). The above-mentioned soluble salt comprises either of a stannous salt, or a mixture of the stannous salt and a salt of a metal selected from the group consisting of silver, copper, bismuth, nickel, antimony, indium and zinc.

The tin alloy of the present invention is an alloy of tin and a predetermined metal selected from silver, copper, bismuth, nickel, antimony, indium and zinc, and may be mentioned, for example, binary alloys such as a tin-silver alloy, a tin-copper alloy, a tin-bismuth alloy, a tin-nickel alloy, a tin-antimony alloy, a tin-indium alloy and a tin-zinc alloy, and ternary alloys such as a tin-copper-bismuth, tin-copper-silver alloys and the like.

Accordingly, the soluble salt (A) of the present invention means an optional soluble salt which forms various kinds of metal ions such as $Sn^{2+}$, $Ag^{+}$, $Cu^{+}$, $Cu^{2+}$, $Bi^{3+}$, $Ni^{2+}$, $Sb^{3+}$, $In^{3+}$, $Zn^{2+}$ and the like in the plating liquid, and may be mentioned, for example, oxides or halides of the metal, the metal salts of an inorganic acid or an organic acid, and the like.

As the metal oxides, there may be mentioned stannous oxide, copper oxide, nickel oxide, bismuth oxide, antimony oxide, indium oxide, zinc oxide and the like, and as the halides of metal, there may be mentioned stannous chloride, bismuth chloride, bismuth bromide, cuprous chloride, cupric chloride, nickel chloride, antimony chloride, indium chloride, zinc chloride and the like.

As the metal salt of an inorganic acid or an organic acid, there may be mentioned copper sulfate, stannous sulfate, bismuth sulfate, nickel sulfate, antimony sulfate, bismuth nitrate, silver nitrate, copper nitrate, antimony nitrate, indium nitrate, nickel nitrate, zinc nitrate, copper acetate, nickel acetate, nickel carbonate, sodium stannate, stannous borofluoride, stannous methanesulfonate, silver methanesulfonate, copper methanesulfonate, bismuth methanesulfonate, nickel methanesulfonate, indium methanesulfonate, bismethanesulfonic acid zinc, stannous ethanesulfonate, bismuth 2-hydroxypropanesulfonate and the like.

The acid or a salt thereof (B) of the present invention is selected from organic acids and inorganic acids, and a salt thereof. The above-mentioned organic acids may be mentioned an organic sulfonic acid such as an alkane sulfonic acid, an alkanol sulfonic acid, an aromatic sulfonic acid and the like, or an aliphatic carboxylic acid and the like, and the inorganic acids may be mentioned fluoroboric acid, hydrofluorosilicic acid, sulfamic acid, hydrochloric acid, sulfuric acid, nitric acid, perchloric acid and the like. The salt thereof is a salt of an alkali metal, a salt of an alkaline earth metal, an ammonium salt, an amine salt, a sulfonic acid salt and the like. The component (B) is preferably an organic sulfonic acid from the viewpoints of solubility of the metal salt and easiness of waste water treatment.

As the above-mentioned alkanesulfonic acid, those represented by the chemical formula $C_nH_{2n+1}SO_3H$ (for example, n=1 to 5, preferably 1 to 3) can be used, and specifically, it may be mentioned methanesulfonic acid, ethanesulfonic acid, 1-propanesulfonic acid, 2-propanesulfonic acid, 1-butanesulfonic acid, 2-butanesulfonic acid, pentanesulfonic acid and the like, and further hexanesulfonic acid, decanesulfonic acid, dodecane-sulfonic acid and the like.

As the above-mentioned alkanolsulfonic acid, those represented by the chemical formula $C_pH_{2p+1}$—CH(OH)—$C_qH_{2q}$—$SO_3H$ (for example, p=0 to 6, q=1 to 5) can be used, and specifically, it may be mentioned 2-hydroxyethane-1-sulfonic acid, 2-hydroxypropane-1-sulfonic acid, 2-hydroxybutane-1-sulfonic acid, 2-hydroxypentane-1-sulfonic acid and the like, and further 1-hydroxy-propane-2-sulfonic acid, 3-hydroxypropane-1-sulfonic acid, 4-hydroxybutane-1-sulfonic acid, 2-hydroxyhexane-1-sulfonic acid, 2-hydroxydecane-1-sulfonic acid, 2-hydroxydodecane-1-sulfonic acid and the like.

The above-mentioned aromatic sulfonic acid is basically benzenesulfonic acid, an alkylbenzenesulfonic acid, a phenolsulfonic acid, a naphthalenesulfonic acid, an alkylnaphthalenesulfonic acid and the like, and specifically mentioned 1-naphthalenesulfonic acid, 2-naphthalenesulfonic acid, toluenesulfonic acid, xylene-sulfonic acid, p-phenolsulfonic acid, cresol sulfonic acid, sulfosalicylic acid, nitrobenzene sulfonic acid, sulfobenzoic acid, diphenylamine-4-sulfonic acid and the like.

The above-mentioned aliphatic carboxylic acid may be mentioned, for example, acetic acid, propionic acid, butyric acid, citric acid, tartaric acid, gluconic acid, sulfosuccinic acid, trifluoroacetic acid and the like.

The amine-based surfactant (C1) contained in the additive (C) of the present invention is a polyoxyethylene alkylamine represented by the following general formula (1).

[Formula 4]

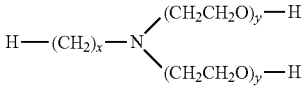

(1)

wherein, in the formula (1), x is 12 to 18 and y is 4 to 12.

The nonionic surfactant (C2 or C3) contained in the additive (C) of the present invention is a condensation product of a polyoxyethylene and a polyoxypropylene represented by the following general formula (2) or general formula (3).

[Formula 5]

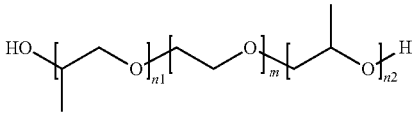

(2)

wherein, in the formula (2), m is 15 to 30, and n1+n2 is 40 to 50.

[Formula 6]

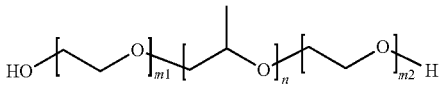

(3)

wherein, in the formula (3), m1+m2 is 15 to 30 and n is 40 to 50.

In the plating liquid of the present invention, it is further preferable to contain two or more among a surfactant other than the above, a complexing agent, a glossing agent and an antioxidant as other additives.

As the other surfactant in this case may be mentioned a usual anionic surfactant, cationic surfactant, nonionic surfactant and amphoteric surfactant.

The anionic surfactant may be mentioned a polyoxyalkylene alkyl ether sulfate such as a polyoxyethylene (ethylene oxide: containing 12 mol) nonyl ether sodium sulfate and the like, a polyoxyalkylene alkyl phenyl ether sulfate such as polyoxyethylene (ethylene oxide: containing 12 mol) dodecyl phenyl ether sodium sulfate and the like, an alkylbenzene sulfonate such as sodium dodecylbenzenesulfonate and the like, a naphthol sulfonate such as sodium 1-naphthol-4-sulfonate, disodium 2-naphthol-3,6-disulfonate and the like, a (poly)alkyl naphthalenesulfonate such as sodium diisopropyl naphthalenesulfonate, sodium dibutyl naphthalenesulfonate and the like, an alkyl sulfate such as sodium dodecyl sulfate, sodium oleyl sulfate and the like.

The cationic surfactant may be mentioned monotrialkylamine salt, dimethyl dialkyl ammonium salt, trimethyl alkyl ammonium salt, dodecyltrimethyl ammonium salt, hexadecyltrimethyl ammonium salt, octadecyltrimethyl ammonium salt, dodecyldimethyl ammonium salt, octadecenyldimethylethyl ammonium salt, dodecyldimethylbenzyl ammonium salt, hexadecyldimethylbenzyl ammonium salt, octadecyldimethylbenzyl ammonium salt, trimethylbenzyl ammonium salt, triethylbenzyl ammonium salt, hexadecylpyridinium salt, dodecylpyridinium salt, dodecylpicolinium salt, dodecylimidazolinium salt, oleylimidazolinium salt, octadecylamine acetate, dodecylamine acetate and the like.

The nonionic surfactant may be mentioned sugar esters, fatty acid esters, $C_1$ to $C_{25}$ alkoxyl phosphoric acids (salt), sorbitan esters, silicone-based polyoxyethylene ether, silicone-based polyoxyethylene ester, fluorine-based polyoxyethylene ether, fluorine-based polyoxyethylene ester, a sulfated or sulfonated adduct of a condensation product of ethylene oxide and/or propylene oxide and an alkylamine or a diamine and the like.

The amphoteric surfactant may be mentioned betaine, carboxybetaine, imidazolinium betaine, sulfobetaine, aminocarboxylic acid and the like.

The above-mentioned complexing agent is used to stabilize noble metal ions or the like in a bath with the plating liquid containing a noble metal such as silver and the like and to make the composition of the deposited alloy uniform. The complexing agents may be mentioned an oxycarboxylic acid, a polycarboxylic acid, a monocarboxylic acid and the like. Specifically, there may be mentioned gluconic acid, citric acid, glucoheptonic acid, gluconolactone, glucoheptonolactone, formic acid, acetic acid, propionic acid, butyric acid, ascorbic acid, oxalic acid, malonic acid, succinic acid, glycolic acid, malic acid, tartaric acid, diglycolic acid, thioglycolic acid, thiodiglycolic acid, thioglycol, thiodiglycol, mercaptosuccinic acid, 3,6-dithia-1,8-octanediol, 3,6,9-trithiadecane-1,11-disulfonic acid, thiobis(dodecaethylene glycol), di(6-methylbenzothiazolyl)disulfide trisulfonic acid, di(6-chlorobenzothiazolyl)disulfide disulfonic acid, gluconic acid, citric acid, glucoheptonic acid, gluconolactone, glucoheptonolactone, dithiodianiline, dipyridyl disulfide, mercaptosuccinic acid, a sulfite, a thiosulfate, ethylenediamine, ethylenediamine tetraacetic acid (EDTA), diethylenetriamine pentaacetic acid (DTPA), nitrilotriacetic acid (NTA), iminodiacetic acid (IDA), iminodipropionic acid (IDP), hydroxyethyl ethylene-diamine triacetic acid (HEDTA), triethylenetetramine hexaacetic acid (TTHA), ethylenedioxybis(ethylamine)-N,N,N',N'-tetraacetic acid, glycines, nitrilotrimethylphosphonic acid, or a salt thereof and the like. In addition, there are sulfur-containing compounds such as thioureas and the like and phosphorus compounds such as tris(3-hydroxypropyl)phosphine and the like. Further, the conductive salt may be mentioned a sodium salt, a potassium salt, a magnesium salt, an ammonium salt, an amine salt of sulfuric acid, hydrochloric acid, phosphoric acid, sulfamic acid, sulfonic acid and the like.

The above-mentioned glossing agent is added to impart gloss to the plating film. The glossing agent may be mentioned various kinds of aldehydes such as benzaldehyde, o-chlorobenzaldehyde, 2,4,6-trichlorobenzaldehyde, m-chlorobenzaldehyde, p-nitrobenzaldehyde, p-hydroxybenzaldehyde, furfural, 1-naphthoaldehyde, 2-naphthoaldehyde, 2-hydroxy-1-naphthoaldehyde, 3-acenaphthoaldehyde, benzylideneacetone, pyridideneacetone, furfurylideneacetone, cinnamaldehyde, anisaldehyde, salicylaldehyde, chrotonaldehyde, acrolein, glutaraldehyde, paraaldehyde, vanilline and the like, triazine, imidazole, indole, quinoline, 2-vinylpyridine, aniline, phenanthroline, neocuproine, picolinic acid, thioureas, N-(3-hydroxybutylidene)-p-sulfanilic acid, N-butylidenesulfanilic acid, N-cinnamoylidenesulfanilic acid, 2,4-diamino-6-(2'-methylimidazolyl (1'))ethyl-1,3,5-triazine, 2,4-diamino-6-(2'-ethyl-4-methylimidazolyl(1'))ethyl-1,3,5-triazine, 2,4-diamino-6-(2'-undecylimidazolyl(1'))ethyl-1,3,5-triazine, phenyl salicylate, or, benzothiazoles such as benzothiazole, 2-mercaptobenzothiazole, 2-methylbenzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, 5-hydroxy-2-methylbenzothiazole and the like.

The above-mentioned antioxidant is used for preventing oxidation of a soluble stannous salt to a stannic salt. The antioxidant may be mentioned, in addition to hypophosphorous acids, ascorbic acid or a salt thereof, phenolsulfonic acid (Na), cresol sulfonic acid (Na), hydroquinone sulfonic acid (Na), hydroquinone, α or β-naphthol, catechol, resorcin, phloroglucin, hydrazine, phenolsulfonic acid, catecholsulfonic acid, hydroxybenzenesulfonic acid, naphtholsulfonic acid, or a salt thereof and the like.

A content of the amine-based surfactant (C1) of the present invention in the plating liquid is 1 to 10 g/L, and preferably 3 to 5 g/L. If the content is less than the appropriate range, the suppression effect of the Sn ions is weak. Also, if it is too large, the effect of suppressing deposition of the Sn ions at a low current density becomes further small, and there is a fear of becoming the height of the bumps uneven.

A content of the nonionic surfactant (C2 and/or C3) of the present invention in the plating liquid is 1 to 10 g/L, and preferably 1 to 5 g/L. If the content is less than the appropriate range, the suppression effect of the Sn ions is weak. Also, if it is too large, depletion of the Sn ions in the vicinity of the objective surface to be plated may be further promoted, and there is a fear of generating plating defects such as dendrite and the like. When both the nonionic surfactant (C2) and the nonionic surfactant (C3) are contained, a total amount of the contents of the nonionic surfactant (C2) and the nonionic surfactant (C3) may be set within the above-mentioned range. The content of both the surfactants of the amine-based surfactant (C1) and the nonionic surfactant (C2 and/or C3) in total in the plating liquid is 1 to 10 g/L, and preferably 1 to 5 g/L.

Also, the above-mentioned predetermined soluble metal salt (A) can be used singly or in combination, and a content thereof in the plating liquid is 30 to 100 g/L, and preferably 40 to 60 g/L. If the content is less than the appropriate range, productivity is lowered, while if the content is too large, a cost of the plating liquid is increased.

The inorganic acid, the organic acid or a salt thereof (B) can be used singly or in combination, and a content thereof in the plating liquid is 80 to 300 g/L, and preferably 100 to 200 g/L. If the content is less than the appropriate range, conductivity is low and voltage is increased, while if the content is too large, a viscosity of the plating liquid is increased and a stirring speed of the plating liquid is lowered.

Incidentally, the addition concentration of each component of the above-mentioned (A) to (C) is to be voluntarily adjusted and selected depending on the plating system such as barrel plating, rack plating, high-speed continuous plating, rackless plating, bump plating and the like.

On the other hand, a liquid temperature of the electroplating liquid of the present invention is generally 70° C. or lower, and preferably 10 to 40° C. A current density at the time of forming a plating film by electroplating is in the range of 0.1 $A/dm^2$ or more and 100 $A/dm^2$ or less, and preferably in the range of 0.5 $A/dm^2$ or more and 20 $A/dm^2$ or less. If the current density is too low, productivity is worsened, while if it is too high, uniformity of the height of the bumps is worsened.

The plating liquid comprising a tin or tin alloy containing both of the amine-based surfactant (C1) and the nonionic surfactant (C2 and/or C3) of the present invention as an additive is applied to an electronic component as a material to be plated, and a predetermined metal film can be formed on the electronic component. As the electronic components, there may be mentioned printed circuit boards, flexible printed circuit boards, film carriers, semiconductor integrated circuits, resistors, capacitors, filters, inductors, thermistors, quartz oscillators, switches, lead wires, and the like. In addition, the plating liquid of the present invention may be applied to a part of an electronic component such as a bump of a wafer and the like to form a film.

EXAMPLES

Next, Examples of the present invention will be explained in detail with Comparative Examples.

(Amine-Based Surfactant (C1), Nonionic Surfactant (C2 or C3) used in Examples and Comparative Examples)

Each structural formula of amine-based surfactants (C1) which are polyoxyethylene alkylamines (C1-1 to C1-11) to be used in Examples 1-1 to 1-15, Examples 2-1 to 2-12, Comparative Examples 1-1 to 1-11 and Comparative Examples 2-1 to 2-13 are shown in Table 1.

TABLE 1

| Compound No. of amine-based surfactant C1 | Structural formula of compounds of amine-based surfactants C1 |
|---|---|
| C1-1 | $H-(CH_2)_{12}-N(CH_2CH_2O)_2H(CH_2CH_2O)_2H$ |
| C1-2 | $H-(CH_2)_{12}-N(CH_2CH_2O)_4H(CH_2CH_2O)_4H$ |
| C1-3 | $H-(CH_2)_{12}-N(CH_2CH_2O)_7H(CH_2CH_2O)_7H$ |
| C1-4 | $H-(CH_2)_{12}-N(CH_2CH_2O)_{12}H(CH_2CH_2O)_{12}H$ |
| C1-5 | $H-(CH_2)_{12}-N(CH_2CH_2O)_{40}H(CH_2CH_2O)_{40}H$ |
| C1-6 | $H-(CH_2)_{16}-N(CH_2CH_2O)_5H(CH_2CH_2O)_5H$ |
| C1-7 | $H-(CH_2)_{16}-N(CH_2CH_2O)_{40}H(CH_2CH_2O)_{40}H$ |
| C1-8 | $H-(CH_2)_{18}-N(CH_2CH_2O)_2H(CH_2CH_2O)_2H$ |
| C1-9 | $H-(CH_2)_{18}-N(CH_2CH_2O)_5H(CH_2CH_2O)_5H$ |
| C1-10 | $H-(CH_2)_{18}-N(CH_2CH_2O)_7H(CH_2CH_2O)_7H$ |
| C1-11 | $H-(CH_2)_{18}-N(CH_2CH_2O)_{40}H(CH_2CH_2O)_{40}H$ |

Condensates of polyoxyethylene and polyoxypropylene which are the nonionic surfactants (C2 or C3) to be used in Examples 1-1 to 1-15, Examples 2-1 to 2-12, Comparative Examples 1-1 to 1-11 and Comparative Examples 2-1 to 2-13 are represented by the above-mentioned general formula (2) or general formula (3). The m, n1+n2 and a molecular weight in the structural formulae (C2-1 to C2-10) of the above-mentioned condensation products represented by the general formula (2) are shown in Table 2. In addition, the m1+m2, n and a molecular weight in the structural formulae (C3-1 to C3-10) of the above-mentioned condensation products represented by the general formula (3) are shown in Table 3. In the formula (2) and the formula (3), m shows a number of ethylene oxide (EO) groups, and n shows a number of propylene oxide (PO) groups, respectively.

TABLE 2

| Compound No. of nonionic surfactant C2 | m | n1 + n2 | Molecular weight |
|---|---|---|---|
| C2-1 | 10 | 30 | 2300 |
| C2-2 | 10 | 40 | 2800 |
| C2-3 | 15 | 30 | 2500 |
| C2-4 | 15 | 40 | 3100 |
| C2-5 | 15 | 50 | 3800 |
| C2-6 | 20 | 40 | 3400 |
| C2-7 | 30 | 40 | 3800 |
| C2-8 | 40 | 50 | 4600 |
| C2-9 | 30 | 60 | 4900 |
| C2-10 | 50 | 60 | 5800 |

TABLE 3

| Compound No. of nonionic surfactant C3 | m1 + m2 | n | Molecular weight |
|---|---|---|---|
| C3-1 | 10 | 30 | 2300 |
| C3-2 | 10 | 40 | 2800 |
| C3-3 | 15 | 30 | 2500 |
| C3-4 | 15 | 40 | 3100 |
| C3-5 | 15 | 50 | 3800 |
| C3-6 | 20 | 40 | 3300 |
| C3-7 | 30 | 40 | 3800 |
| C3-8 | 40 | 50 | 4800 |
| C3-9 | 30 | 60 | 4900 |
| C3-10 | 50 | 60 | 5800 |

Bath Preparation of Sn Plating Liquid

Example 1-1

Methanesulfonic acid as a free acid and catechol as an antioxidant were mixed with a Sn methanesulfonate aqueous solution, and after the mixture became a uniform solution, a polyoxyethylene alkylamine (mass average molecular weight: 800) of the above-mentioned No. C1-3 and a condensation product of a polyoxyethylene and a polyoxypropylene (mass average molecular weight: 3,100, EO group: PO group (molar ratio) of the polyalkylene oxide group=15:40) of the above-mentioned No. C2-4 were further added thereto as surfactants. And finally, ion exchange water was added thereto to prepare a bath of a Sn plating liquid having the following composition. Incidentally, the Sn methanesulfonate aqueous solution was prepared by electrolyzing a metal Sn plate in a methanesulfonic acid aqueous solution.

Composition of Sn Plating Liquid

Sn methanesulfonate (as $Sn^{2+}$): 80 g/L
Methanesulfonic acid (as free acid): 150 g/L
Catechol: 1 g/L
Amine-based surfactant C1-3: 5 g/L
Nonionic surfactant C2-4: 5 g/L
Ion exchange water: balance Examples 1-6 to 1-10, Examples 2-1, 2-2, 2-5 to 2-8, 2-11 and 2-12, Comparative Examples 1-2, 1-3, 1-5, 1-6 and 1-9 to 1-11, and Comparative Examples 2-1, 2-3 to 2-5, 2-7, 2-9 to 2-11 and 2-13

In Examples 1-6 to 1-10, Examples 2-1, 2-2, 2-5 to 2-8, 2-11 and 2-12, Comparative Examples 1-2, 1-3, 1-5, 1-6 and 1-9 to 1-11 and Comparative Examples 2-1, 2-3 to 2-5, 2-7, 2-9 to 2-11 and 2-13, the surfactants having the properties shown in Table 1 to Table 3 were used as an amine-based surfactant (C1) and a nonionic surfactant (C2 or C3). Other than these, in the same manner as in Example 1, Sn plating liquids of the above-mentioned Examples and the above-mentioned Comparative Examples were prepared as a bath. Incidentally, in Comparative Example 1-11, an amine-based surfactant (C1) was not used. In Comparative Example 2-13, the nonionic surfactant (C2 and/or C3) was not used.

Bath Preparation of SnAg Plating Liquid

Example 1-2

Methanesulfonic acid as a free acid, catechol as an antioxidant, thiourea as a complexing agent and benzaldehyde as a glossing agent were mixed with a Sn methanesulfonate aqueous solution and after dissolving the mixture, an Ag methanesulfonate liquid was further added thereto and mixed. After obtaining a uniform solution by mixing, a polyoxyethylene alkylamine (mass average molecular weight: 1300) of the above-mentioned No. C1-4, a condensation product of a polyoxyethylene and a polyoxypropylene of the above-mentioned C2-4 (mass average molecular weight: 3,100, EO group:PO group (molar ratio) of the polyalkylene oxide group=15:40) were further added thereto as surfactants. And finally, ion exchange water was added thereto to prepare a bath of a SnAg plating liquid having the following composition. Incidentally, the Sn methanesulfonate aqueous solution was prepared by electrolyzing a metal Sn plate, and the Ag methanesulfonate aqueous solution was prepared by electrolyzing a metal Ag plate, in a methanesulfonic acid aqueous solution, respectively.

Composition of SnAg Plating Liquid

Methanesulfonic acid Sn (as $Sn^{2+}$): 80 g/L
Methanesulfonic acid Ag (as $Ag^{+}$): 1.0 g/L
Methanesulfonic acid (as free acid): 150 g/L
Catechol: 1 g/L
Thiourea: 2 g/L
Benzaldehyde: 0.01 g/L
Amine-based surfactant C1-4: 3 g/L
Nonionic surfactant C2-4: 4 g/L
Ion exchange water: balance Examples 1-4, 1-11, 1-13 and 1-15, Examples 2-3 and 2-9, Comparative Examples 1-1, 1-4 and 1-8, and Comparative Examples 2-6 and 2-12

In Examples 1-4, 1-11, 1-13 and 1-15, Examples 1-6 and 2-12, Comparative Examples 1-1, 1-4 and 1-8, and Comparative Examples 2-6 and 2-12, the surfactants having the properties shown in Table 1 to Table 3 were used as surfactants. Other than these, in the same manner as in Example 1-2, SnAg plating liquids of the above-mentioned Examples and the above-mentioned Comparative Examples were prepared as a bath.

Bath Preparation of SnCu Plating Liquid

Example 1-3

Methanesulfonic acid as a free acid, catechol as an antioxidant and thiourea as a complexing agent were mixed with a Sn methanesulfonate aqueous solution, and after dissolving the mixture, a Cu methanesulfonate liquid was further added thereto and mixed. After obtaining a uniform solution by mixing, a polyoxyethylene alkylamine (mass average molecular weight: 650) of the above-mentioned No. C1-6 and a condensation product of a polyoxyethylene and a polyoxypropylene (mass average molecular weight: 3,100, EO group:PO group (molar ratio) of the polyalkylene oxide group=15:40) of the above-mentioned C2-4 as surfactants were further added thereto. And finally, ion exchange water was added thereto to prepare a bath of a SnCu plating liquid having the following composition. Incidentally, the Sn methanesulfonate aqueous solution was prepared by electrolyzing a metal Sn plate, and the Cu methanesulfonate aqueous solution was prepared by electrolyzing a metal Cu plate, in a methanesulfonic acid aqueous solution, respectively.

Composition of SnCu Plating Liquid

Sn methanesulfonate (as $Sn^{2+}$): 80 g/L
Cu methanesulfonate (as $Cu^{2+}$): 0.5 g/L
Methanesulfonic acid (as free acid): 150 g/L
Catechol: 1 g/L
Thiourea: 2 g/L
Amine-based surfactant C1-6: 3 g/L
Nonionic surfactant C2-4: 3 g/L
Ion exchange water: balance Examples 1-5, 1-12, 1-14, Examples 2-4, 2-10, Comparative Examples 1-7, Comparative Examples 2-2, 2-8

In Examples 1-5, 1-12 and 1-14, Examples 2-4 and 2-10, Comparative Example 1-7, and Comparative Examples 2-2 and 2-8, the surfactants having the properties shown in Table 1 to Table 3 were used as surfactants. Other than these, in the same manner as in Example 1-3, SnCu plating liquids of the above-mentioned Examples and the above-mentioned Comparative Examples were prepared as a bath.

Example 3-1

Methanesulfonic acid as a free acid and catechol as an antioxidant were mixed with a Sn methanesulfonate aqueous solution, and after the mixture became a uniform solution, a polyoxyethylene alkylamine (mass average molecular weight: 1,300) of the above-mentioned No. C1-4, a condensation product of a polyoxyethylene and a polyoxypropylene (mass average molecular weight: 3,100, EO group:PO group (molar ratio) of the polyalkylene oxide group=15:40) of the above-mentioned C2-4, a condensation product of a polyoxyethylene and a polyoxypropylene (mass average molecular weight: 3,100, EO group:PO group (molar ratio) of the polyalkylene oxide group=15:40) of the above-mentioned C3-4 were further added thereto as surfactants. And finally, ion exchange water was added thereto to prepare a bath of a Sn plating liquid having the following composition. Incidentally, the Sn methanesulfonate aqueous solution was prepared by electrolyzing a metal Sn plate in a methanesulfonic acid aqueous solution.

Composition of Sn Plating Liquid

Sn methanesulfonate (as $Sn^{2+}$): 80 g/L
Methanesulfonic acid (as free acid): 150 g/L
Catechol: 1 g/L
Amine-based surfactant C1-3: 5 g/L
Nonionic surfactant C2-4: 3 g/L
Nonionic surfactant C3-4: 2 g/L
Ion exchange water: balance Example 3-2

Methanesulfonic acid as a free acid, catechol as an antioxidant, thiourea as a complexing agent and benzaldehyde as a glossing agent were mixed with a Sn methanesulfonate aqueous solution and after dissolving the mixture, an Ag methanesulfonate liquid was further added thereto and mixed. After obtaining a uniform solution by mixing, a polyoxyethylene alkylamine (mass average molecular weight: 1,300) of the above-mentioned No. C1-4 and a condensation product of a polyoxyethylene and a polyoxypropylene (mass average molecular weight: 3,400, BO group:PO group (molar ratio) of the polyalkylene oxide group=20:40) of the above-mentioned C2-6, and a condensation product of a polyoxyethylene and a polyoxypropylene (mass average molecular weight: 3,800, BO group:PO group (molar ratio) of the polyalkylene oxide group=30:40) of the above-mentioned C3-7 were further added thereto as surfactants. And finally, ion exchange water was added thereto to prepare a bath of a SnAg plating liquid having the following composition. Incidentally, the Sn methanesulfonate aqueous solution was prepared by electrolyzing a metal Sn plate, and the Ag methanesulfonate aqueous solution was prepared by electrolyzing a metal Ag plate, in a methanesulfonic acid aqueous solution, respectively.

Composition of SnAg Plating Liquid

Sn methanesulfonate (as $Sn^{2+}$): 80 g/L
Ag methanesulfonate (as $Ag^{+}$): 1.0 g/L
Methanesulfonic acid (as free acid): 150 g/L
Catechol: 1 g/L
Thiourea: 2 g/L
Benzaldehyde: 0.01 g/L
Amine-based surfactant C1-4: 3 g/L
Nonionic surfactant C2-6: 2 g/L
Nonionic surfactant C3-7: 2 g/L
Ion exchange water: balance <Comparative Test and Evaluation>

A plating film (bump) was prepared by using three kinds of the plating liquids prepared as baths of Examples 1-1 to 1-15, Examples 2-1 to 2-12, Comparative Examples 1-1 to 1-11, Comparative Examples 2-1 to 2-13, and Examples 3-1 to 3-2, and uniformity of the thickness of the plating film inside the die (WID) and likeliness of generation of voids during the reflow process were evaluated. The results are shown in Table 4 to Table 6.

(1) Uniformity of Thickness of Plating Film Inside Die (WID)

A seed layer for electrical conduction of 0.1 μm of titanium and 0.3 μm of copper was formed on the surface of a wafer (8 inches) by sputtering method, and a dry film resist (film thickness of 50 μm) was laminated onto the seed layer. Then, the dry film resist was partially exposed through a mask for exposure, and thereafter, subjected to development treatment. Thus, as shown in FIG. 1, a resist layer 3 having a pattern in which openings 2 having a diameter of 90 μm had been formed at different pitch distances of a: 150 μm, b: 225 μm, c: 375 μm on the surface of the wafer 1 was formed.

The wafer 1 on which the resist layer 3 had been formed was immersed in a plating apparatus (dip type paddle stirring apparatus), and the openings 2 of the resist layer 3 were plated at a liquid temperature of the plating liquid: 25° C. and three conditions of the current densities: 4 ASD, 8 ASD and 12 ASD, respectively. Then, the wafer 1 was taken out from the plating apparatus, washed and dried, and then, the resist layer 3 was peeled off using an organic solvent. Thus, a wafer attached with bumps in which bumps having a diameter of 90 μm were formed with a pattern arranged with a different pitch distance of 150 μm, 225 μm and 375 μm in one die was produced. The heights of the bumps of this wafer were measured by using an automatic appearance inspection apparatus. From the measured heights of the bumps, uniformity of the film thickness of the plating inside of the die (WID) was calculated according to the following equation. The results are shown at the column of "WID" in Table 1.

$$WID=(\text{maximum height}-\text{minimum height})/(2\times\text{average height})\times 100$$

It was made the criteria that the thickness of the plating film being uniform where the WID was 5 or less when the current density was 4 ASD, the WID was 15 or less when the current density was 8 ASD, and the WID was 20 or less when the current density was 12 ASD, respectively.

(2) Likeliness of Generating Voids

The seed layer of the wafer attached with the bumps produced in the above-mentioned (1) where the current density was made 12 ASD was subjected to etching and removed, and then heated to 240° C. using a reflow apparatus to melt the bumps. After allowing to cool, transmission X-ray images were photographed with respect to bumps (2,000 bumps in total) arranged at each pitch distance of 150 μm, 225 μm and 375 μm. The photographed images were visually observed, when one or more voids having a size of 1% or more based on the size of the bumps were observed, it was determined as "NG", and when no void was observed, it was determined as "OK". The results are shown at the column of "void" of Table 4 to Table 6.

TABLE 4

| | Amine-based surfactant (C1) | | Nonionic surfactant (C2 or C3) | | | | Evaluation | | | |
|---|---|---|---|---|---|---|---|---|---|---|
| | | | | | | | WID | | | Void |
| | Compound No. | Mass average molecular weight | Compound No. | EO group:PO group (molar ratio) | Mass average molecular weight | Metal other than Sn | 4ASD | 8ASD | 12ASD | 12ASD |
| Example 1-1 | C1-3 | 800 | C2-4 | 15:40 | 3100 | — | 4 | 12 | 16 | OK |
| Example 1-2 | C1-4 | 1300 | C2-4 | 15:40 | 3100 | Ag | 4 | 11 | 17 | OK |

TABLE 4-continued

| | Amine-based surfactant (C1) | | Nonionic surfactant (C2 or C3) | | | | Evaluation | | | |
|---|---|---|---|---|---|---|---|---|---|---|
| | | | | | | | WID | | | Void |
| | Compound No. | Mass average molecular weight | Compound No. | EO group:PO group (molar ratio) | Mass average molecular weight | Metal other than Sn | 4ASD | 8ASD | 12ASD | 12ASD |
| Example 1-3 | C1-6 | 650 | C2-4 | 15:40 | 3100 | Cu | 4 | 11 | 17 | OK |
| Example 1-4 | C1-9 | 720 | C2-4 | 15:40 | 3100 | Ag | 5 | 12 | 16 | OK |
| Example 1-5 | C1-10 | 850 | C2-4 | 15:40 | 3100 | Cu | 4 | 12 | 17 | OK |
| Example 1-6 | C1-3 | 800 | C3-5 | 30:40 | 3800 | — | 4 | 12 | 17 | OK |
| Example 1-7 | C1-4 | 1300 | C3-5 | 30:40 | 3800 | — | 5 | 13 | 16 | OK |
| Example 1-8 | C1-6 | 650 | C3-5 | 30:40 | 3800 | — | 4 | 11 | 17 | OK |
| Example 1-9 | C1-9 | 720 | C3-5 | 30:40 | 3800 | — | 4 | 12 | 16 | OK |
| Example 1-10 | C1-10 | 850 | C3-5 | 30:40 | 3800 | — | 4 | 12 | 17 | OK |
| Example 1-11 | C1-3 | 800 | C2-4 | 15:40 | 3100 | Ag | 4 | 11 | 17 | OK |
| Example 1-12 | C1-4 | 1300 | C2-4 | 15:40 | 3100 | Cu | 5 | 13 | 16 | OK |
| Example 1-13 | C1-6 | 650 | C3-5 | 30:40 | 3800 | Ag | 4 | 11 | 17 | OK |
| Example 1-14 | C1-9 | 720 | C3-5 | 30:40 | 3800 | Cu | 4 | 12 | 16 | OK |
| Example 1-15 | C1-10 | 850 | C3-5 | 30:40 | 3800 | Ag | 4 | 12 | 17 | OK |
| Comparative Example 1-1 | C1-1 | 350 | C2-4 | 15:40 | 3100 | Ag | 11 | 19 | 29 | OK |
| Comparative Example 1-2 | C1-5 | 4000 | C2-4 | 15:40 | 3100 | — | 11 | 19 | 38 | NG |
| Comparative Example 1-3 | C1-7 | 4000 | C2-4 | 15:40 | 3100 | — | 10 | 18 | 35 | NG |
| Comparative Example 1-4 | C1-8 | 400 | C2-4 | 15:50 | 3100 | Ag | 11 | 19 | 29 | OK |
| Comparative Example 1-5 | C1-11 | 4000 | C2-4 | 15:50 | 3100 | — | 12 | 19 | 31 | NG |
| Comparative Example 1-6 | C1-1 | 350 | C3-5 | 30:40 | 3800 | — | 11 | 18 | 30 | OK |
| Comparative Example 1-7 | C1-5 | 4000 | C3-5 | 30:40 | 3800 | Cu | 12 | 19 | 38 | NG |
| Comparative Example 1-8 | C1-7 | 4000 | C3-5 | 30:40 | 3800 | Ag | 11 | 18 | 31 | NG |
| Comparative Example 1-9 | C1-8 | 400 | C3-5 | 30:40 | 3800 | — | 11 | 19 | 29 | OK |
| Comparative - Example 1-10 | C1-11 | 4000 | C3-5 | 30:40 | 3800 | — | 13 | 20 | 31 | NG |
| Comparative Example 1-11 | — | — | C3-5 | 30:40 | 3800 | — | 5 | 13 | 36 | OK |

TABLE 5

| | Amine-based surfactant (C1) | | Nonionic surfactant (C2 or C3) | | | | Evaluation | | | |
|---|---|---|---|---|---|---|---|---|---|---|
| | | | | | | | WID | | | Void |
| | Compound No. | Mass average molecular weight | Compound No. | EO group:PO group (molar ratio) | Mass average molecular weight | Metal other than Sn | 4ASD | 8ASD | 12ASD | 12ASD |
| Example 2-1 | C1-4 | 1300 | C2-4 | 15:40 | 3100 | — | 4 | 11 | 16 | OK |
| Example 2-2 | C1-4 | 1300 | C2-5 | 15:50 | 3800 | — | 4 | 12 | 16 | OK |
| Example 2-3 | C1-4 | 1300 | C2-5 | 15:50 | 3800 | Ag | 4 | 10 | 15 | OK |
| Example 2-4 | C1-4 | 1300 | C2-5 | 15:50 | 3800 | Cu | 4 | 11 | 15 | OK |
| Example 2-5 | C1-4 | 1300 | C2-6 | 20:40 | 3400 | — | 5 | 13 | 16 | OK |
| Example 2-6 | C1-4 | 1300 | C2-7 | 30:40 | 3800 | — | 4 | 11 | 17 | OK |
| Example 2-7 | C1-4 | 1300 | C3-4 | 15:40 | 3100 | — | 4 | 11 | 17 | OK |
| Example 2-8 | C1-4 | 1300 | C3-5 | 15:50 | 3800 | — | 5 | 12 | 16 | OK |
| Example 2-9 | C1-4 | 1300 | C3-5 | 15:50 | 3800 | Ag | 4 | 11 | 16 | OK |
| Example 2-10 | C1-4 | 1300 | C3-5 | 15:50 | 3800 | Cu | 4 | 11 | 17 | OK |
| Example 2-11 | C1-4 | 1300 | C3-6 | 20:40 | 3400 | — | 4 | 13 | 18 | OK |
| Example 2-12 | C1-4 | 1300 | C3-7 | 30:40 | 3800 | — | 5 | 11 | 17 | OK |
| Comparative Example 2-1 | C1-4 | 1300 | C2-1 | 10:30 | 2300 | — | 18 | 20 | 26 | OK |
| Comparative Example 2-2 | C1-4 | 1300 | C2-2 | 10:40 | 2800 | Cu | 11 | 19 | 28 | OK |
| Comparative Example 2-3 | C1-4 | 1300 | C2-3 | 15:30 | 2500 | — | 13 | 20 | 27 | OK |

TABLE 5-continued

| | Amine-based surfactant (C1) | | Nonionic surfactant (C2 or C3) | | | | Evaluation | | | |
|---|---|---|---|---|---|---|---|---|---|---|
| | | | | | | | WID | | | Void |
| | Compound No. | Mass average molecular weight | Compound No. | EO group:PO group (molar ratio) | Mass average molecular weight | Metal other than Sn | 4ASD | 8ASD | 12ASD | 12ASD |
| Comparative Example 2-4 | C1-4 | 1300 | C2-8 | 40:50 | 4600 | — | 16 | 20 | 36 | NG |
| Comparative Example 2-5 | C1-4 | 1300 | C2-9 | 30:60 | 4900 | — | 18 | 21 | 26 | NG |
| Comparative Example 2-6 | C1-4 | 1300 | C2-10 | 50:60 | 5800 | Ag | 18 | 23 | 21 | NG |
| Comparative Example 2-7 | C1-4 | 1300 | C3-1 | 10:30 | 2300 | — | 19 | 21 | 26 | OK |
| Comparative Example 2-8 | C1-4 | 1300 | C3-2 | 10:40 | 2800 | Cu | 15 | 19 | 30 | OK |
| Comparative Example 2-9 | C1-4 | 1300 | C3-3 | 15:30 | 2500 | — | 14 | 20 | 29 | OK |
| Comparative Example 2-10 | C1-4 | 1300 | C3-8 | 40:50 | 4600 | | 17 | 20 | 36 | NG |
| Comparative Example 2-11 | C1-4 | 1300 | C3-9 | 30:60 | 4900 | — | 18 | 20 | 32 | NG |
| Comparative Example 2-12 | C1-4 | 1300 | C3-10 | 50:60 | 5800 | Ag | 18 | 21 | 29 | NG |
| Comparative Example 2-13 | C1-4 | 1300 | — | —:— | — | — | 16 | 20 | 36 | OK |

TABLE 6

| | Amine-based surfactant (C1) | | Nonionic surfactant (C2): Upper column Nonionic surfactant (C3): Lower column | | | | Evaluation | | | |
|---|---|---|---|---|---|---|---|---|---|---|
| | | | | | | | WID | | | Void |
| | Compound No. | Mass average molecular weight | Compound No. | EO group:PO group (molar ratio) | Mass average molecular weight | Metal other than Sn | 4ASD | 8ASD | 12ASD | 12ASD |
| Example 3-1 | C1-4 | 1300 | C2-4<br>C3-4 | 15:40<br>15:40 | 3100<br>3100 | — | 4 | 11 | 17 | OK |
| Example 3-2 | C1-4 | 1300 | C2-6<br>C3-7 | 20:40<br>30:40 | 3400<br>3800 | Ag | 4 | 11 | 15 | OK |

As clearly seen from Table 1 and Table 4, in Comparative Example 1-1 and Comparative Example 1-6, y in the formula (1) of the amine-based surfactant (C1-1) was 2, which was not in the range of 4 to 12 so that, whereas there was some wafers having no void in the bumps, the WID exceeded the criteria over the current density range from 4 ASD to 12 ASD, and the thickness of the plating film was not uniform.

In Comparative Example 1-2 and Comparative Example 1-7, y in the formula (1) of the amine-based surfactant (C1-5) was 40, which was not in the range of 4 to 12, so that the WID exceeded the criteria over the current density range from 4 ASD to 12 ASD, and the thickness of the plating film was not uniform. Further, voids were also generated.

In Comparative Example 1-3 and Comparative Example 1-8, y in the formula (1) of the amine-based surfactant (C1-7) was 40, which was not in the range of 4 to 12, so that the WID exceeded the criteria over the current density range from 4 ASD to 12 ASD, and the thickness of the plating film was not uniform. Further, voids were also generated.

In Comparative Example 1-4 and Comparative Example 1-9, y in the formula (1) of the amine-based surfactant (C1-8) was 2, which was not in the range of 4 to 12 so that, whereas voids were not found in the bumps, the WID exceeded the criteria over the current density range from 4 ASD to 12 ASD, and the thickness of the plating film was not uniform.

In Comparative Example 1-5 and Comparative Example 1-10, y in the formula (1) of the amine-based surfactant (C1-11) was 40, which was not in the range of 4 to 12, so that the WID exceeded the criteria over the current density range from 4 ASD to 12 ASD, and the thickness of the plating film was not uniform. Also, in Comparative Example 1-5, no void was found but in Comparative Example 1-10, voids were also generated.

In Comparative Example 1-11, since the surfactant was the nonionic surfactant (C3-5) alone, no void was found in the bumps, and the WID satisfied the criteria at the current density of 4 ASD and 8 ASD, and the thickness of the plating film was uniform, but at the current density of 12 ASD, the WID exceeded the criteria and the thickness of the plating film was not uniform. That is, although the nonionic surfactant (C2 or C3) had a suppressing effect necessary to suppress unevenness of the height of the plating, there was a low effect of promoting supply of the Sn ions with the single material, so that the current density became high, exhaustion of the Sn ions occurred and the WID was worsened.

As clearly seen from Table 2 and Table 5, in Comparative Examples 2-1, m of the EO group in the formula (2) of the nonionic surfactant (C2-1) was 10, which was not in the range of 15 to 30, and n1+n2 of the PO group was 30, which was not in the range of 40 to 50 so that, whereas voids were not found in the bumps, the WID exceeded the criteria over the current density range from 4 ASD to 12 ASD, and the thickness of the plating film was not uniform.

In Comparative Example 2-2, n1+n2 of the PO group in the formula (2) of the nonionic surfactant (C2-2) was 40, which was in the range of 40 to 50, but m of the EO group was 10, which was not in the range of 15 to 30 so that, whereas voids were not found in the bumps, the WID exceeded the criteria over the current density range from 4 ASD to 12 ASD, and the thickness of the plating film was not uniform.

In Comparative Example 2-3, m of the EO group in the formula (2) of the nonionic surfactant (C2-3) was 15, which was in the range of 15 to 30, but n1+n2 of the PO group was 30, which was not in the range of 40 to 50 so that, whereas voids were not found in the bumps, the WID exceeded the criteria over the current density range from 4 ASD to 12 ASD, and the thickness of the plating film was not uniform.

In Comparative Example 2-4, n1+n2 of the PO group in the formula (2) of the nonionic surfactant (C2-8) was 50, which was in the range of 40 to 50, but m of the EO group was 40, which was not in the range of 15 to 30, so that the WID exceeded the criteria over the current density range from 4 ASD to 12 ASD, and the thickness of the plating film was not uniform. Further, voids were also generated.

In Comparative Example 2-5, m of the EO group in the formula (2) of the nonionic surfactant (C2-9) was 30, which was in the range of 15 to 30, but n1+n2 of the PO group was 60, which was not in the range of 40 to 50, so that the WID exceeded the criteria over the current density range from 4 ASD to 12 ASD, and the thickness of the plating film was not uniform. Further, voids were also generated.

In Comparative Example 2-6, m of the EO group in the formula (2) of the nonionic surfactant (C2-10) was 50, which was not in the range of 15 to 30, and n1+n2 of the PO group was 60, which was not in the range of 40 to 50, so that the WID exceeded the criteria over the current density range from 4 ASD to 12 ASD, and the thickness of the plating film was not uniform. Further, voids were also generated.

As clearly seen from Table 3 and Table 5, in Comparative Example 2-7, m1+m2 of the EO group in the formula (3) of the nonionic surfactant (C3-1) was 10, which was not in the range of 15 to 30, and n of the PO group was 30, which was not in the range of 40 to 50, whereas voids were not found in the bumps, so that the WID exceeded the criteria over the current density range from 4 ASD to 12 ASD, and the thickness of the plating film was not uniform.

In Comparative Example 2-8, n of the PO group in the formula (3) of the nonionic surfactant (C3-2) was 40, which was in the range of 40 to 50, but m1+m2 of the EO group was 10, which was not in the range of 15 to 30 so that, whereas voids were not found in the bumps, so that the WID exceeded the criteria over the current density range from 4 ASD to 12 ASD, and the thickness of the plating film was not uniform.

In Comparative Example 2-9, m1+m2 of the EO group in the formula (3) of the nonionic surfactant (C3-3) was 15, which was in the range of 15 to 30, but n of the PO group was 30, which was not in the range of 40 to 50 so that, whereas voids were not found in the bumps, the WID exceeded the criteria over the current density range from 4 ASD to 12 ASD, and the thickness of the plating film was not uniform.

In Comparative Example 2-10, n of the PO group in the formula (3) of the nonionic surfactant (C3-8) was 50, which was in the range of 40 to 50, but m1+m2 of the EO group was 40, which was not in the range of 15 to 30, so that the WID exceeded the criteria over the current density range from 4 ASD to 12 ASD, and the thickness of the plating film was not uniform. Further, voids were also generated.

In Comparative Example 2-11, m1+m2 of the EO group in the formula (3) of the nonionic surfactant (C3-9) was 30, which was in the range of 15 to 30, but n of the PO group was 60, which was not in the range of 40 to 50, so that the WID exceeded the criteria over the current density range from 4 ASD to 12 ASD, and the thickness of the plating film was not uniform. Further, voids were also generated.

In Comparative Example 2-12, m1+m2 of the EO group in the formula (3) of the nonionic surfactant (C3-10) was 50, which was not in the range of 15 to 30, and n of the PO group was 60, which was not in the range of 40 to 50, so that the WID exceeded the criteria over the current density range from 4 ASD to 12 ASD, and the thickness of the plating film was not uniform. Further, voids were also generated.

In Comparative Example 2-13, the surfactant was the amine-based surfactant (C1-4) alone, so that no void was observed, but the WID exceeded the criteria over the current density range from 4 ASD to 12 ASD, and the thickness of the plating film was not uniform. That is, although the amine-based surfactant (C1) had an effect of promoting supply of the Sn ions but a suppressing effect necessary to suppress unevenness of the height of the plating could not be obtained with the single material, and the WID was high.

To the contrary, as clearly seen from Table 4 to Table 6, in Examples 1-1 to 1-15, Examples 2-1 to 2-12 and Examples 3-1 to 3-2, x in the formula (1) of the amine-based surfactants (C1-3), (C1-4), (C1-6), (C1-9) and (C1-10) was in the range of 12 to 18, y was in the range of 4 to 12, and m:n1+n2 or m1+m2:n of the EO group:the PO group (molar ratio) of the nonionic surfactants (C2-4), (C2-2), (C2-5), (C2-6), (C2-7), (C3-4), (C3-5), (C3-6) and (C3-7) was in the range of 15 to 30:40 to 50, so that no void was observed in the bumps, and the WID was in the criteria over the current density range from 4 ASD to 12 ASD whereby the thickness of the plating film was uniform. That is, by appropriately combining the amine-based surfactant (C1) and the nonionic surfactant (C2 and/or C3), good WID over the wide current density of 4 to 12 ASD and bumps without void could be obtained.

INDUSTRIAL APPLICABILITY

The plating liquid of the present invention can be utilized for electronic components such as printed circuit boards, flexible printed circuit boards, film carriers, semiconductor integrated circuits, resistors, capacitors, filters, inductors, thermistors, quartz oscillators, switches, lead wires, and the like, and a part of electronic components such as bumps of wafers, and the like.

The invention claimed is:

1. A plating liquid comprising (A) a soluble salt containing at least a stannous salt, (B) an acid selected from organic acids and inorganic acids or a salt thereof, and (C) an additive, wherein the additive contains two kinds of surfactants of an amine-based surfactant (C1) and a nonionic surfactant(s) (C2 and/or C3), the amine-based surfactant (C1) is a polyoxyethylene alkylamine represented by the following general formula (1), and the nonionic surfactant (C2 or C3) is a condensation product of a polyoxyethylene and a polyoxypropylene represented by the following general formula (2) or general formula (3),

[Formula 1]

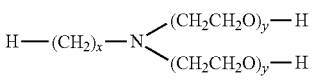

(1)

wherein, in the formula (1), x is 12 to 18 and y is 4 to 12,

[Formula 2]

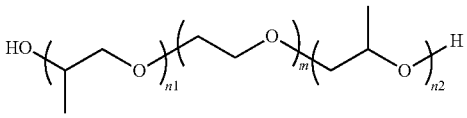

(2)

wherein, in the formula (2), m is 15 to 30 and n1+n2 is 40 to 50,

[Formula 3]

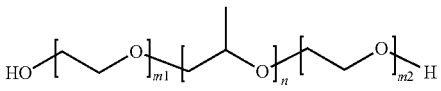

(3)

wherein, in the formula (3), m1+m2 is 15 to 30 and n is 40 to 50.

2. The plating liquid according to claim 1, wherein the additive further comprises two or more other additives among a surfactant other than the two kinds of the surfactants (C1, C2 and/or C3), a complexing agent, a glossing agent and an antioxidant.

3. The plating liquid according to claim 1, wherein a content of the amine-based surfactant (C1) of the present invention in the plating liquid is 1 to 10 g/L.

4. The plating liquid according to claim 3, wherein the content of the amine-based surfactant (C1) of the present invention in the plating liquid is 3 to 5 g/L.

5. The plating liquid according to claim 1, wherein a content of the nonionic surfactant (C2 and/or C3) of the present invention in the plating liquid is 1 to 10 g/L.

6. The plating liquid according to claim 5, wherein the content of the nonionic surfactant (C2 and/or C3) of the present invention in the plating liquid is 1 to 5 g/L.

7. The plating liquid according to claim 1, wherein a content of both the surfactants of the amine-based surfactant (C1) and the nonionic surfactant (C2 and/or C3) in total in the plating liquid is 1 to 10 g/L.

8. The plating liquid according to claim 7, wherein the content of both the surfactants of the amine-based surfactant (C1) and the nonionic surfactant (C2 and/or C3) in total in the plating liquid is 1 to 5 g/L.

9. The plating liquid according to claim 1, wherein the acid or a salt thereof (B) is an organic sulfonic acid or a salt thereof.

10. The plating liquid according to claim 1, wherein the acid or a salt thereof (B) is an alkane sulfonic acid, an alkanol sulfonic acid, an aromatic sulfonic acid, or an aliphatic carboxylic acid.

11. The plating liquid according to claim 1, wherein the acid or a salt thereof (B) is an inorganic acid or a salt thereof.

12. The plating liquid according to claim 1, wherein the acid or a salt thereof (B) is a fluoroboric acid, hydrofluorosilicic acid, sulfamic acid, hydrochloric acid, sulfuric acid, nitric acid, or perchloric acid.

13. The plating liquid according to claim 1, wherein a content of the soluble metal salt (A) is 30 to 100 g/L.

14. The plating liquid according to claim 12, wherein the content of the soluble metal salt (A) is 40 to 60 g/L.

15. The plating liquid according to claim 1, wherein a content of the inorganic acid, the organic acid or a salt thereof (B) is 80 to 300 g/L.

16. The plating liquid according to claim 15, wherein the content of the inorganic acid, the organic acid or a salt thereof (B) is 100 to 200 g/L.

* * * * *